US006244763B1

(12) United States Patent
Miller

(10) Patent No.: US 6,244,763 B1
(45) Date of Patent: Jun. 12, 2001

(54) PC POSTAGE LABEL CONTAINING THREE PRIMARY LABELS FOR INDICIA, SENDER AND RECIPIENT AND METHOD FOR PRINTING SAME

(75) Inventor: Christopher Patrick Miller, Aliso Viejo, CA (US)

(73) Assignee: Stamps.Com, Santa Monica, CA (US)

( * ) Notice: Subject to any disclaimer, the term of this patent is extended or adjusted under 35 U.S.C. 154(b) by 0 days.

(21) Appl. No.: 09/439,531

(22) Filed: Nov. 12, 1999

(51) Int. Cl.[7] ..... B41J 11/44
(52) U.S. Cl. ..... 400/76; 400/70; 400/61
(58) Field of Search ..... 400/76, 61, 70, 400/615.2; 281/2

(56) References Cited

U.S. PATENT DOCUMENTS 5,413,037 * 5/1995 Auslander et al. ..... 101/9
5,829,895 * 11/1998 Hayashi et al. ..... 400/124.05
6,010,156 * 1/2000 Block ..... 281/2

* cited by examiner

*Primary Examiner*—John S. Hilten
*Assistant Examiner*—Charles H. Nolan, Jr.
(74) *Attorney, Agent, or Firm*—Christie, Parker & Hale, LLP

(57) ABSTRACT

A sheet having at least one self-adhesive special purpose label arrangement set having a postage indicia label, an addressee label, and a sender label, wherein the maximum printable area of the sheet is made available for the labels, and a process for printing these special purpose label arrangement sets. In the process, a computer system with a printer is provided. A postage computer program for preparing and printing the labels is provided, and information concerning the addressee, the sender, and a mail piece to be mailed and how it is to be mailed is inputted into the postage computer program. The postage computer software will interface with and direct the printer to print the label set with the postage indicia, the addressee information, and sender information, preferably in a single pass through the printer. The postage value can be obtained via the Internet or in other manners.

40 Claims, 6 Drawing Sheets

PC POSTAGE LABEL CONTAINING THREE PRIMARY LABELS FOR INDICIA, SENDER AND RECIPIENT AND METHOD FOR PRINTING SAME

BACKGROUND OF THE INVENTION

This invention is in the field of labels, and more particularly a special purpose label arrangement set for use in PC postage that has a label portion for postage indicia, an addressee label portion, and a sender label portion, and a method for printing this special purpose label arrangement with the necessary information. The special purpose label arrangement set is more generally applicable to printing with a variety of information.

SUMMARY OF THE INVENTION

The United States Postal Service (USPS) has responded to recent technological developments in the telecommunication and computer field by developing its Information Based Indicia Program (IBIP.) The IBIP involves the development of new technology to produce new forms of postage. In so-called PC Postage, a user can purchase postage credit, and print the postage in the form of PC Postage onto a label or directly onto the mail piece. The PCT Postage includes a human readable portion and a 2-dimensional barcode portion. The human readable portion includes the postage value, mail class, the date, and optionally a logo. The barcode portion is intended to help thwart fraud, and includes information about the mail piece including the destination ZIP code, the amount of postage applied, the date and time the postage was applied, and a digital signature so that the USPS can validate the authenticity of the postage.

In one preferred embodiment of PC Postage, a user will subscribe to a third party central server location, such as Stamps.com (of Santa Monica, Calif.), and by using postage software made available by the central server location, postage value can be downloaded to the user's computer. The user can then print the postage indicia, by an ordinary laser or ink jet printer, directly onto the mail piece itself (onto a standard business envelope), or onto a label to be applied to the mail piece. This postage software works in conjunction with other software programs, such as word processing, accounting, database, and contact management software to allow a user to conveniently print out PC Postage at the same time that addressee and bar code information is printed (and in the case of envelope printing also the sender's return address.)

In order to permit the sophisticated mail handling and optical reading equipment at the USPS to properly interpret the PC Postage and addressee information, it is critical that the postage indicia be applied properly. Indeed, the USPS has established strict guidelines directed to the margins, label sizes, and placement of the Postage Indicia, and the size, placement, and other characteristics of the POSTNET (POStal Numeric Encoding Technique) bar codes, and any facing identification mark (FEM) on mail pieces. These guidelines are contained in the Domestic Mail Manual (DMM) and Title 39, Code of Federal Register (CFR), Part 111.

The various typically available laser and ink jet printers differ in their ability to print close to the edge of sheets of self-adhesive labels fed into the printer, and typically cannot print within 0.635 cm to 1.27 cm (0.25 inch to 0.5 inch) of each edge of the sheet. In their most common embodiment, these home, office and small laser and ink jet printers are designed to accept sheets having a maximum width of 21.59 cm (8.5 inches), or in the case of wide format printers, about 27.94 cm (11 inches.) However, the majority of the home and office printers are of the 21.59 cm (8.5 inches) variety, and accordingly most self-adhesive labels sheets have a width of 21.59 cm (8.5 inches) or less. To accommodate a variety of printers (and their different print-free margin requirements), most self-adhesive labels are provided on sheets that have relatively wide margins. Unfortunately, formatting self-adhesive labels with overly wide margins reduces the footprint available for the labels and therefore reduces the number and/or size labels that can be provided per sheet.

E-Stamp.com's Internet Postage starter kit includes samples of self-adhesive labels from Avery® identified as Postage & Address Labels #2869 and #2866, and labels for template #2859. These label sheets include the words "Patent Pending". The #2866 labels consist of single enlarged labels with fluorescent strips on the top and right side edges. The #2866 label design is stated as being large enough to print postage and addresses on labels for packages. The #2859 and #2869 labels consist of two labels per set, with fluorescent strips on the top and right side edges of the upper and larger label in each of the two labels per set. The larger upper label in these sets is for the postage indicia, and the smaller label is for the addressee. There is no provision for printing of the sender's address along with the postage indicia label and addressee label.

As noted above, the postage indicia includes such information as the destination ZIP code. It would be highly useful to have a special purpose label arrangement that has a label portion for the postage indicia, an addressee label portion, and a sender label portion, so that during the printing of postage indicia onto a self-adhesive label, additional labels for the addressee and sender can also be simultaneously printed by the user, as a set, thereby eliminating the need to print sender labels in a separate step. Furthermore, since some users include additional unique identifying information along with mail piece, (such as account numbers), which can be placed in the vicinity of the sender's address on the mail piece, it would be beneficial to print all three labels in a single step.

It would be convenient to provide a method to permit printing of a special purpose label arrangement that has a label portion for the postage indicia, an addressee label portion, and a sender label portion in a single step.

DETAILED DESCRIPTION OF THE INVENTION

Figure 1:
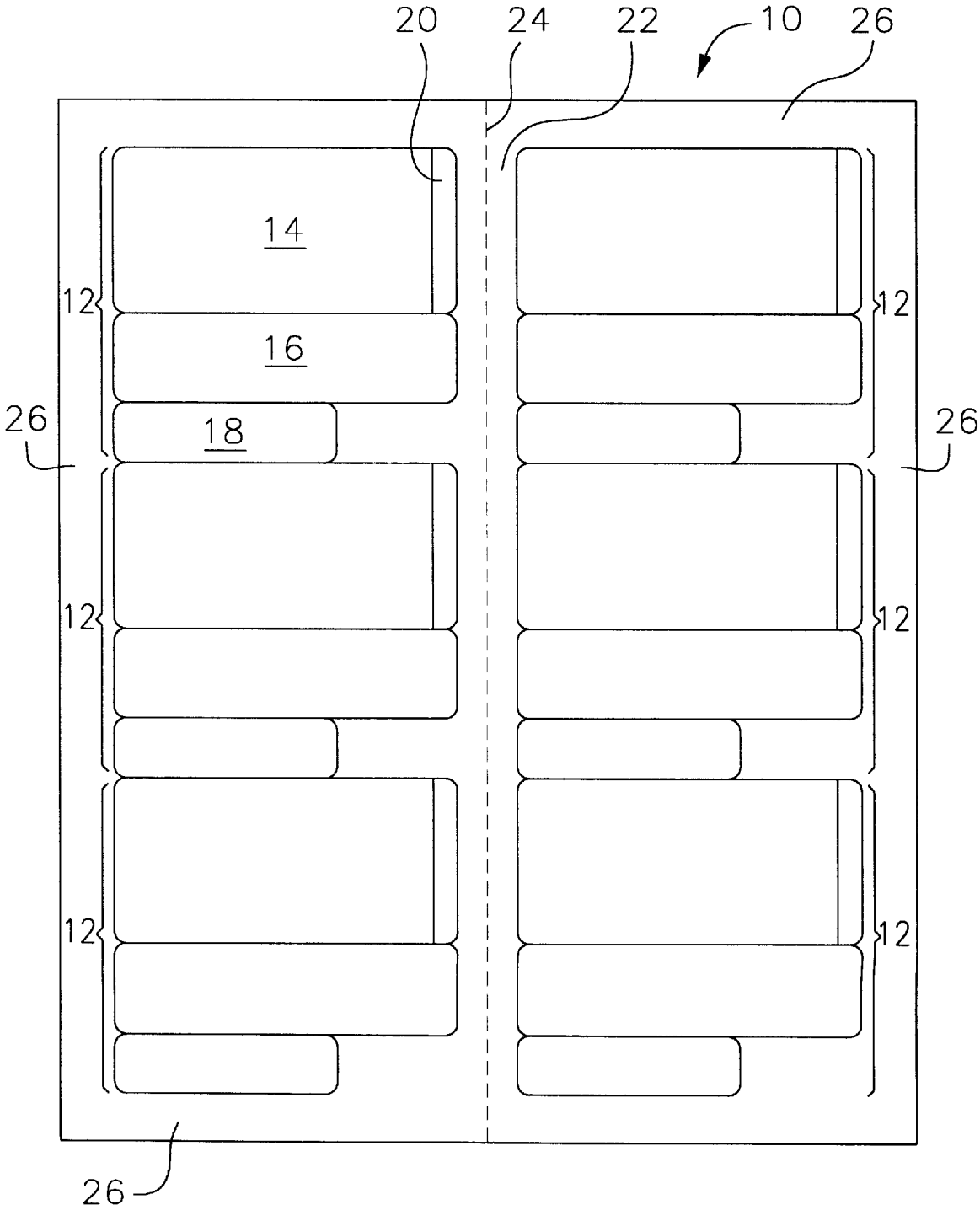
FIG. 1 is a plan view of a first embodiment of a sheet of a plurality of sets of self-adhesive label arrangements of the invention, each set having a label portion for the postage indicia, an addressee label portion, and a sender label portion.

Referring first to FIG. 1, there is shown a plan view of a first embodiment of a single sheet 10 of self-adhesive labels of the invention. In sheet 10, a plurality of label arrangement set 12 are provided. Each label arrangement set 12 has a postage indicia label 14, an addressee label 16, and a sender label 18, arranged to abut each other at their top and bottom edges. These sets are arranged in a portrait orientation on the sheet 10 with the widths of the labels 14, 16 and 18 being parallel to the shorter dimension of sheet 10. Postage indicia label 14 has a fluorescent strip 20 on a right hand edge. The construction of sheet 10 of self-adhesive labels is conventional in that sheet 10 includes a backing sheet (not shown) with low adhesion from which labels 14, 16 and 18 can be detached and then permanently attached to a mailing piece (not shown). Sizing of label arrangement set 12 for an 21.59 cm×cm 27.94 (8.5 inches×11 inches) sheet 10 can preferably be made as follows:

Postage indicia label 14 is about 8.89 cm (3.5 inches) wide and 4.45 cm (1.75 inches) high. Addressee label 16 is about 8.89 cm (3.5 inches) wide and 2.54 cm (1 inch) high. Sender label 18 is about 5.72 cm (2.25 inches) wide and about 1.43 cm (0.5625 inches) high. In FIG. 1, at least one left side edges of labels 14, 16 and 18 are in line, but since addressee label 18 is narrower than postage indicia label 14 and addressee label 16, its position could be shifted (e.g. to be aligned with a right edge of postage indicia label 14 and addressee label 16.) Also, the relative ordering of labels 14, 16 and 18 in set 12 can be shifted (e.g. sender label 18 could be positioned between postage indicia label 14 and addressee label 16) with minor modifications to the software. With the above-noted sizing of labels 14, 16 and 18 in set 12, six sets 12 can be arranged on an 21.54 cm×27.94 cm (8.5 inches×11 inches) sheet, with three label sets 12 on a left hand side and three sets 12 on a right hand side, leaving about a 1.27 cm (0.5 inch) print-free margins 26 on the left, right, top and bottom edges of sheet 10, and optionally with a 1.27 cm (0.5 inch) print-free central dividing area 22 between side-by-side sets 12 on sheet 10. The area on the single sheet 10 excluding the print-free margins 26 comprises a printable footprint areas of the sheet. If desired, a weakened line 24 (e.g. as by a line of micro-perforations) can be formed through central dividing area 22 of sheet 10 and its backing layer that separates side-by-side sets of labels 12 on sheet 10. This feature will allow sheet 10 to be separated into left and right sheet halves if desired, and the separate halves can be separately feed into a printer. As can be seen, the sum of the heights of labels 14, 16 and 18 of the plurality of sets 12 on the left side and right side of the sheet 10 is equal the long dimension of the printable footprint area, and the sum of side-by-side postage indicia labels 14 (and addressee labels 16) plus the width of the optional print-free central dividing area 22 is equal to the shorter dimension of the printable footprint, thereby maximizing the area of the sheet 10 available for the labels 14, 16 and 18.

Figure 2:
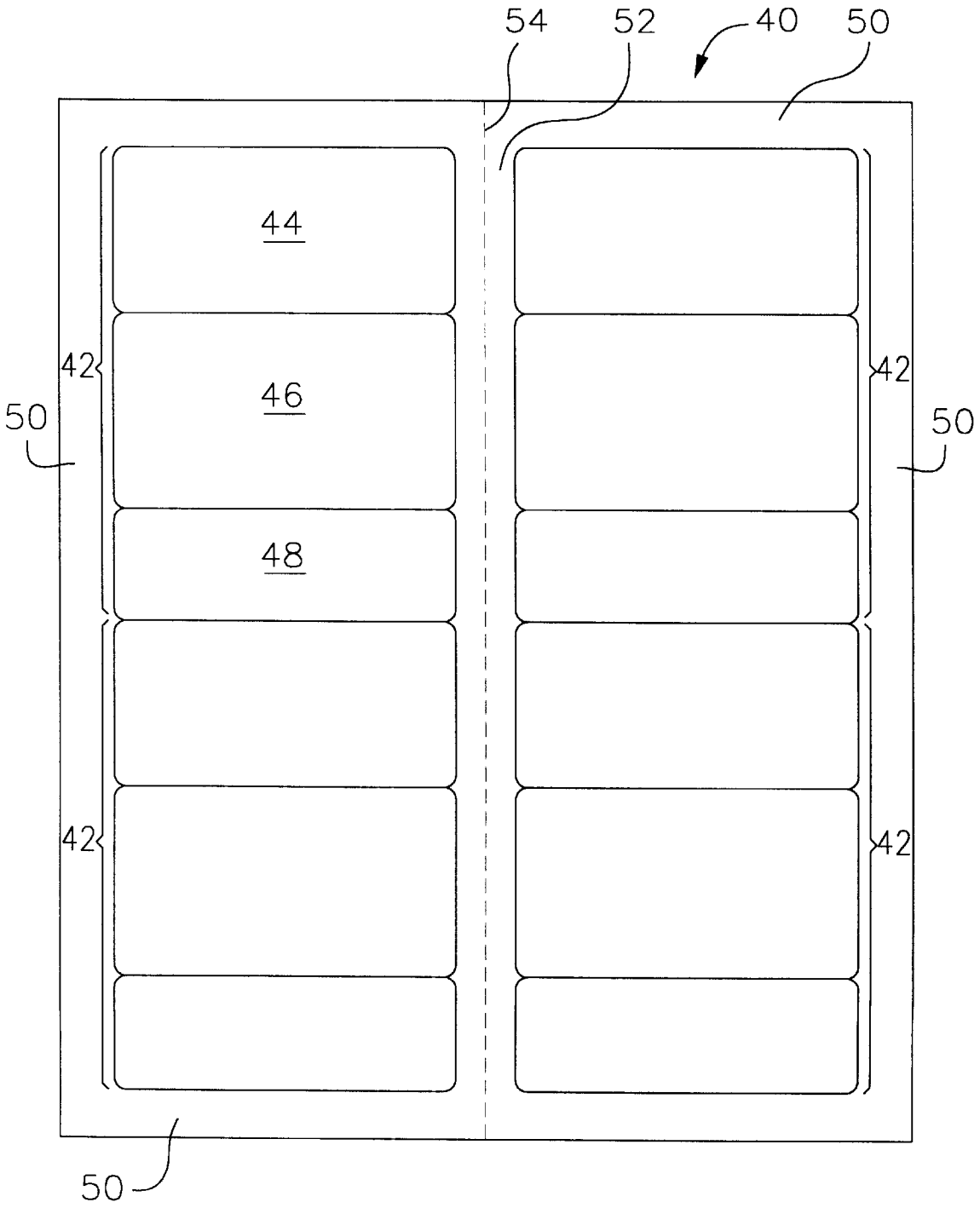
FIG. 2. is a plan view of a second embodiment of a sheet of self-adhesive labels of the invention.

FIG. 2. is a plan view of a second embodiment of a single sheet of self-adhesive labels 40 of the invention which is adapted for non-envelope applications, such as for bulky packages and the like. In sheet 40, a plurality of label arrangement sets 42 are provided and as shown, are in a portrait orientation on sheet with the widths of the labels 44, 46 and 48 being parallel to the shorter dimension of sheet 40. Each set 42 has a postage indicia label 44, an addressee label portion 46, and a sender label 48, arranged to abut each other at their top and bottom edges. Unlike the first embodiment of label sheets 10, under postal regulations, no fluorescent strip need be provided on the postage indicia labels 44. The construction of sheet 40 of self-adhesive labels is conventional in that sheet 40 provides a backing sheet (not shown) with low adhesion from which labels 44, 46 and 48 can be peeled and then permanently attached to a mail piece. Sizing of labels for an 21.54 cm×27.94 cm (8.5 inches×11 inches) sheet can preferably be made as follows:

Postage indicia label 44 is about 8.89 cm (3.5 inches) wide and 4.45 cm (1.75 inches) high. Addressee label 46 is about 8.89 cm (3.5 inches) wide and 5.08 cm (2 inches) high. Sender label 48 is about 8.89 cm (3.5 inches) wide and about 3.81 cm (1.5 inches) high inches high. All labels 44, 46 and 48 have the same width and preferably are aligned with their side edges in line. The relative ordering of labels 44, 46 and 48 in set 42 can be shifted as desired (e.g. label 48 could be positioned between labels 44 and 46.) Sized as noted above, six sets 62 can be arranged on an 21.59 cm×27.94 cm (8.5 inches×11 inches) sheet, with three label sets 42 on a left hand side and three sets 42 on a right hand side, leaving about a 1.27 cm (0.5 inch) wide margins 50 on the left, right, top and bottom edges of sheet 40, and with a 1.27 cm (0.5 inch) central dividing space 52 between side-by-side sets 42 on sheet 40. The area on the single sheet 40 excluding the print-free perimeter margins 50 comprises a printable footprint area of the sheet. If desired, a weakened line 54 (e.g. as by a line of micro-perforations) can be formed through a central dividing area 52 of sheet 10 and its backing layer that separates side-by-side sets of labels 42 on sheet 40. Central dividing area 52 can be about 1.27 cm (0.5 inches) wide (with about 0.635 cm (0.25 inch) of central dividing area 52 on each side of weakened line 54.) This feature will allow sheet 40 to be separated into two halves if desired, and the separate halves can be separately feed into a printer. As can be seen, the sum of the heights of all labels 44, 46 and 48 of the plurality of sets 42 on the left side and right side of single sheet 40 is equal to the longer dimension of the printable footprint area, and the sum of any of the side-by-side postage indicia labels 44 (or addressee labels 46) plus the width optional print-free central dividing area 52 is equal to the shorter dimension of the printable footprint, thereby maximizing the area of sheet 40 available for labels 44, 46 and 48.

Figure 3:
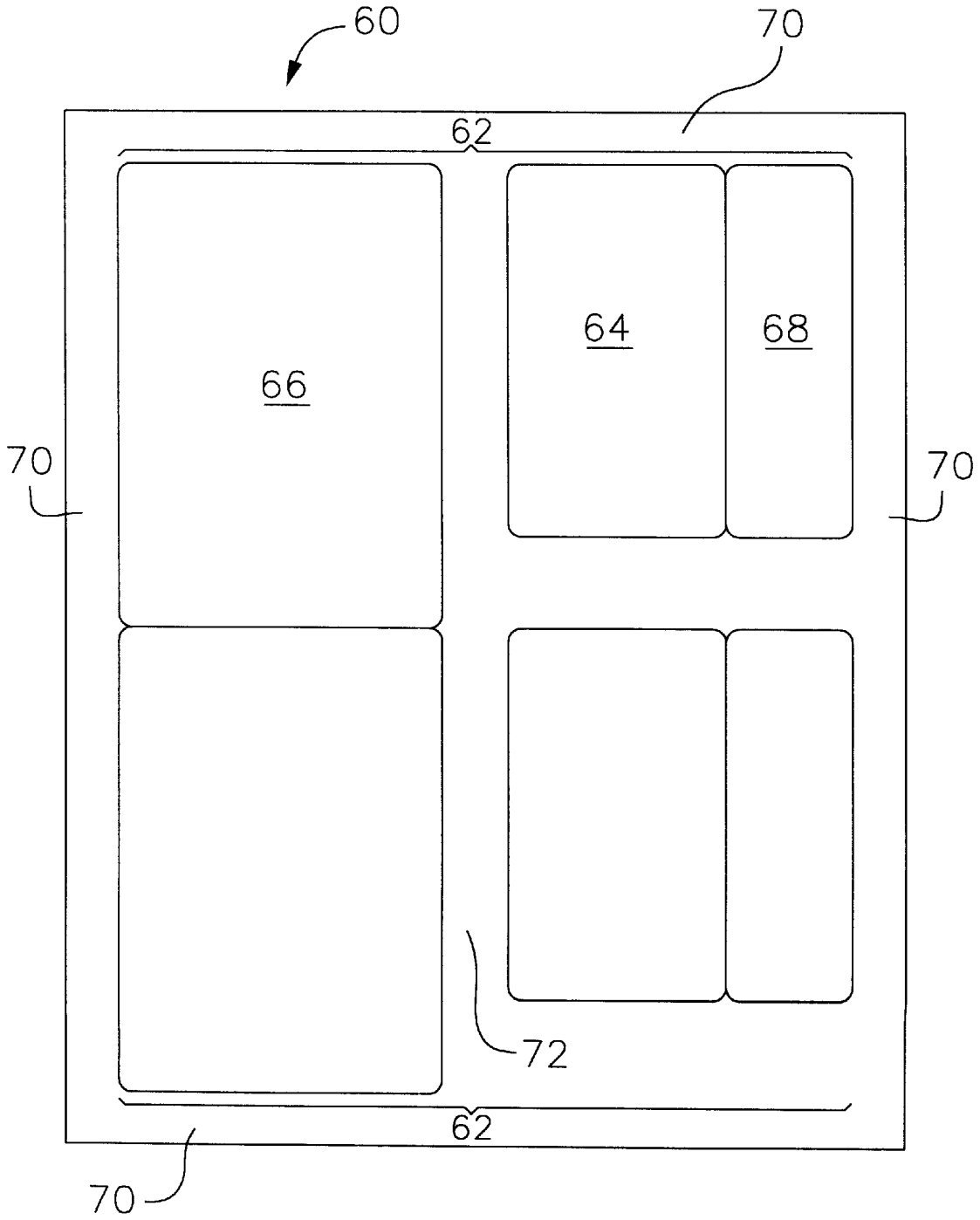
FIG. 3 is a plan view of a third embodiment of a sheet of self-adhesive labels of the invention.

FIG. 3 is a plan view of a third embodiment of a single sheet of self-adhesive labels 60 of the invention. In sheet 60, a plurality (viz. two) label arrangement sets 62 are provided. However, a half-size sheet could also be configured to carry a single label arrangement set if desired (not shown). As shown, the sheet is preferably a standard sized sheet, such as 21.59 cm×29.94 cm (8.5 inches×11 inches), but could be other sizes as well. Label sets 62 are well-suitable for use on large packages and parcels. Each set 62 has a postage indicia label 64, an addressee label 66, and a sender label 68. Unlike the embodiment of FIGS. 1 and 2, each set 62 is arranged on sheet 60 in a landscape orientation, wherein the longer widths of label 64, 66 and 68 are aligned with the longer dimension of sheet 60. In this embodiment, labels 64, 66 and 68 are shown with addressee label 66 on a left hand side of sheet 60, and sender label 68 and postage indicia label 64 on a right hand side of sheet 60.

Sizing of label sets 62 for an 21.59 cm×27.94 cm (8.5 inches×11 inches) sheet can preferably be made as follows: Addressee label portion 66 is about 12.70 cm (5 inches)

wide and 8.89 cm (3.5 inches) high. Postage indicia label portion 64 is about 10.16 cm (4 inches) wide and 5.08 cm (2 inches) high. Sender label portion 68 is about 10.16 cm (4 inches) wide and 3.81 cm (1.5 inches) high. The print-free margins 70 around the two set 62 of labels on sheet 60 are preferably a minimum of 1.27 cm (0.5 inches) on the top, bottom, left and right sides. The area on the single sheet 60 excluding the print-free margins 70 comprises a printable footprint area of the single sheet. A central dividing area 72 optionally can run down the center of sheet 60 between labels 66 and 64, or labels 66 and 64 can be positioned to abut each other on a long edge. The relative arrangement of labels 64, 66 and 68 on sheet 60 can be rearranged if desired, (e.g. putting addressee label 66 on a right hand side and labels 64 and 68 on a left hand side, and/or flipping relative positions of labels 64 and 68) so long as the minimum print-free margins of perimeter of sheet 60 are preserved. The sum of the widths of the two side-by-side addressee labels 66 is equal to the longer dimension of the printable footprint area of sheet 60. The sum of the heights of the labels 64, 66 and 68, plus the width of the central dividing area 72 is equal to the shorter dimension of the footprint area.

The above dimensions are all for standard 21.59 cm×27.94 cm (8.5 inches×11 inches) sheets. Other size sheets can be used as well, such as A4 size (21.0 cm×29.7 cm), legal size (21.59 cm×35.6 cm), or smaller sized sheets can be used, with necessary changes being made to the label set sizes, arrangements, and print free margins (so long as minimum required print-free borders are maintained.) Print free margins of about 1.27 cm (0.5 inch) have been found to accommodate the majority of modern computer printers, but other dimensions could be used as well.

The invention also provides a process for printing a special purpose label arrangement set with a postage indicia label, an addressee label and a sender label in a single step.

Figure 4A:
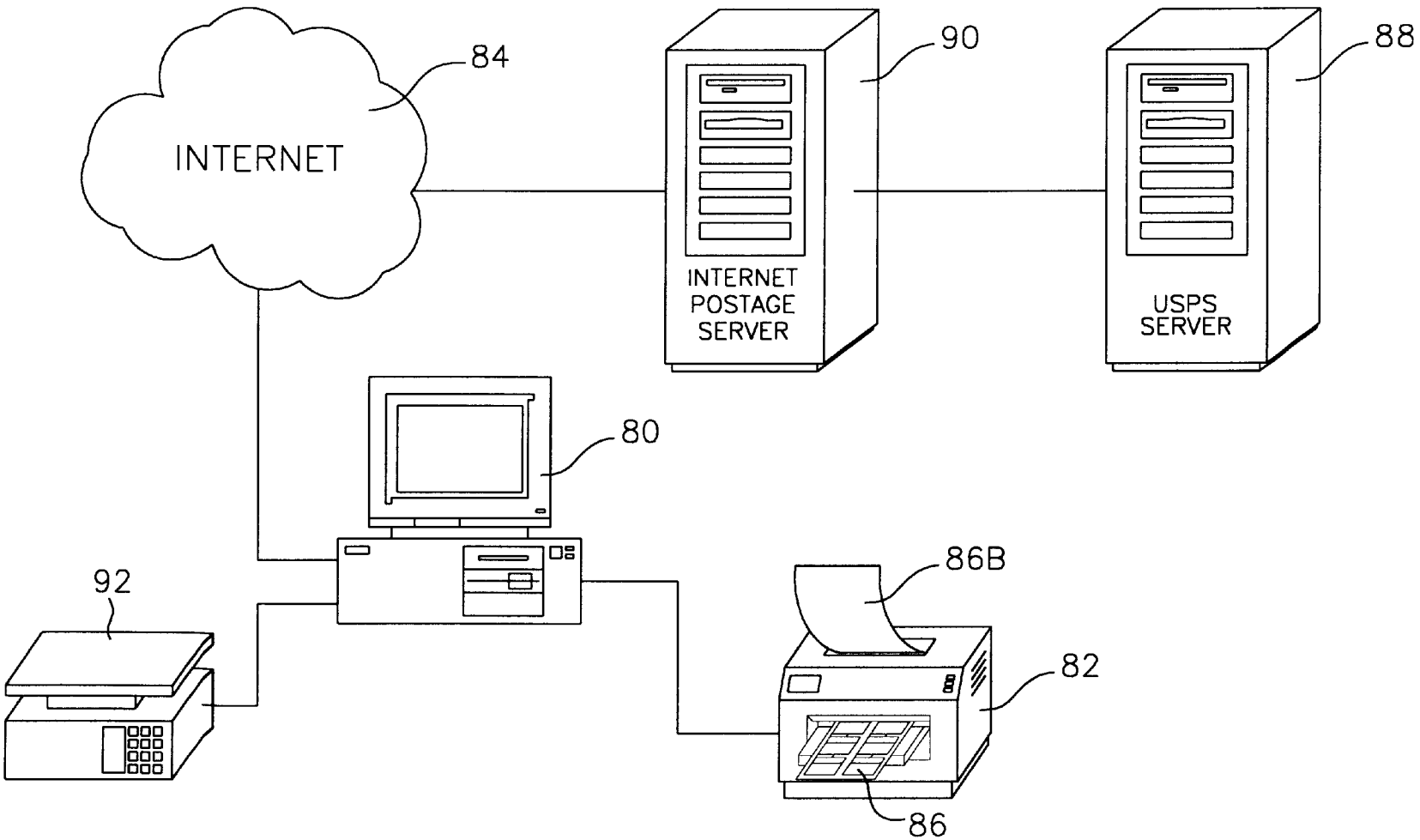
FIG. 4A. is a diagrammatic view showing a first embodiment of a method of the invention wherein a sheet of self-adhesive labels of the invention is being fed into a printer for printing with the postage indicia, addressee, and sender information.

Referring to FIG. 4A, there is depicted a first embodiment of the method, wherein a user will provide a computer system 80 and a printer 82, and computer system 80 is to be connected to the Internet 84. A sheet of adhesive labels 86 is provided. Each sheet of labels 86 includes at least one, and preferably a plurality of special purpose label arrangement sets, each set having a postage indicia label, an addressee label, and a sender label. A United States Postal Service Server 88 (or other national postal server for use of the method in foreign countries) is connected to the Internet Postage Server 90, both of which are connected to the Internet 84.

Specialized computer software for printing the postage indicia on the postage indicia label will be provided. For example, computer software such as described in U.S. patent application Ser. No. 09/163,993, filed on Sep. 29, 1998, by Mohan Ananda, entitled "On Line Postage System", assigned to Stamps.com, the assignee of the present invention, is incorporated by reference as if appearing as full herein. This specialized postage computer software program will preferably integrate with other computer software such as word processing, contact management, calendaring database, and accounting programs, to name a few, and will thus allow sharing of information, such as addressee information and account information. Postal value is obtained (e.g. from the Internet.)

This postage value can be obtained in blocks and stored on the user's computer or a device attached to the computer, or can be downloaded as needed (e.g. 33¢ at a time). The user will indicate the style of label sheet being used (e.g. that of FIG. 1, 2, 3, or some other style of label sheet) and the set number (e.g. top right set) be printed. In another step, the user will input the addresses information (e.g. from a document being typed, from information directly entered into the postage software, from the address book or database of another program, or in some other manner.) The correct postage value for the postage indicia label takes into consideration the sender's address, the destination address, the type of mail service to be used, and the weight and/or size of the postal piece being mailed. An optional electronic scale 92 connected to the computer system 80 can be used to automatically provide the mailing piece's weight. The user may wish to print a return address label, which may be the sender's primary return address or some other address (e.g. an address for billing purposes, an address for customer service, etc.) Other information can also be printed onto the sender's label including, for example, a billing or account code. Some parts of the return address information, or other information identifying the user, such as origin zip code and origin city can be contained on the postage indicia label. Accordingly, there is a considerable amount of coordination required between the different data, the different software, and the label attributes in order to properly print the label sets. The specialized computer program will then direct the printer to print the postage indicia label, the addressee label, and the sender label of the correct set (e.g. the middle left set) of the special purpose label arrangement set, preferably in a single pass through the printer. The ordering of the above described steps is not critical, and could be varied.

Figure 4B:
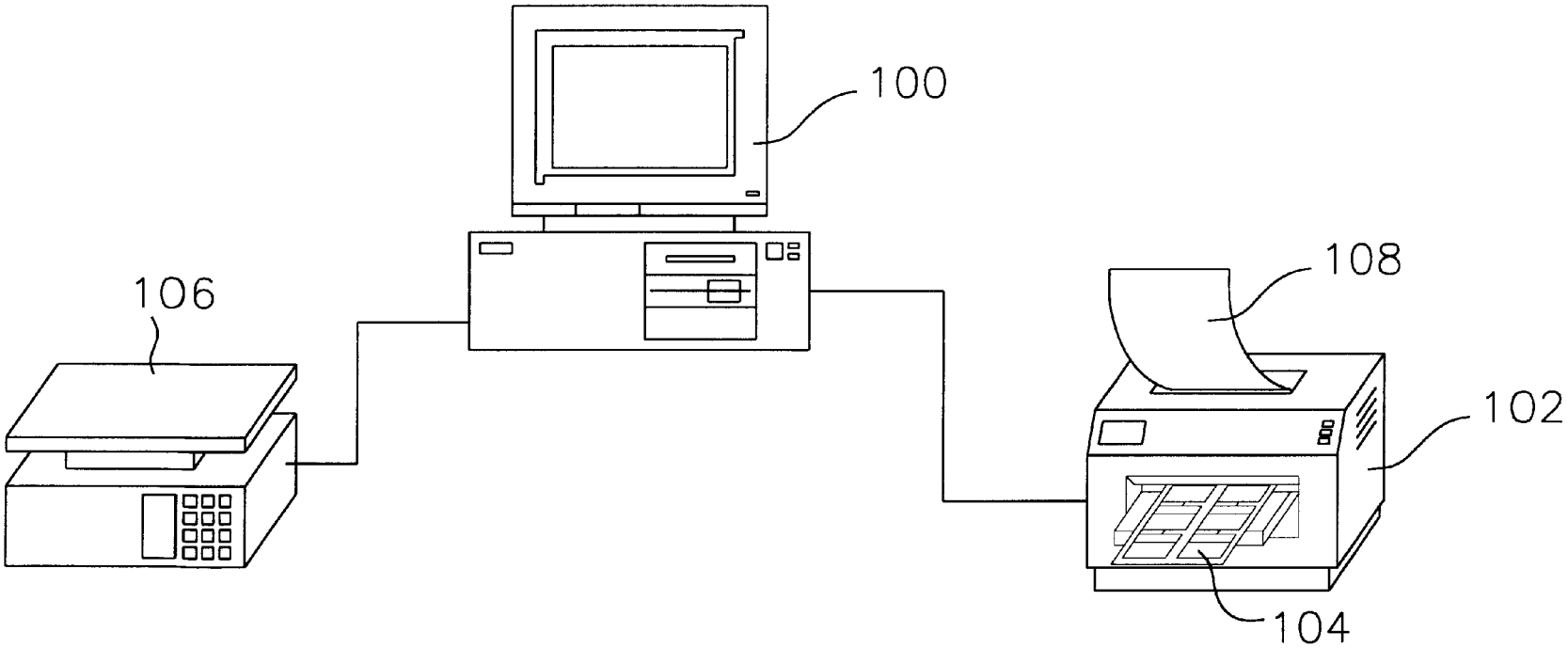
FIG. 4B is a diagrammatic view showing a second embodiment of a method of the invention wherein a sheet of self-adhesive labels of the invention is being fed into a printer for printing with the postage indicia, addressee, and sender information.

Referring now to FIG. 4B, there is depicted a second embodiment of the method, whereas means other than the Internet can be used for obtaining postal value. In this second embodiment, the user will provide a computer system 100 and a printer 102. Each sheet of labels 104 includes at least one, and preferably a plurality of special purpose label arrangement sets, each set having a postage indicia label, an addressee label, and a sender label.

The postage value can be obtained in blocks and stored on the user's computer or a device attached to the computer, or can be obtained as needed. The user will indicate the style of label sheet being used (e.g. that of FIG. 1, 2, 3, or some other style of label sheet) and the set number (e.g. top right set) be printed. In another step, the user will input the addresses information (e.g. from a document being typed, from information directly entered into the postage software, from the address book or database of another program, or in some other manner.) The correct postage value for the postage indicia label takes into consideration the sender's address, the destination address, the type of mail service to be used, and the weight and/or size of the postal piece being mailed. An optional electronic scale connected to the computer system 106 can be used to automatically provide the mailing piece's weight. The user may wish to print a return address label, which may be the sender's primary return address or some other address (e.g. an address for billing purposes, an address for customer service, etc.) Other information can also be printed onto the sender's label including, for example, a billing or account code. Some parts of the return address information, or other information identifying the user, such as origin zip code and origin city can be contained on the postage indicia label. Accordingly, there is a considerable amount of coordination required between the different data, the different software, and the label attributes in order to properly print the label sets. The computer program will then direct the printer to print the postage indicia label, the addressee label, and the sender label of the correct set (e.g. the middle left set) of the special purpose label arrangement set to form completed label set 108, which may preferably occur in a single pass through printer 102. The ordering of the above described steps is not critical, and could be varied.

Figure 5:
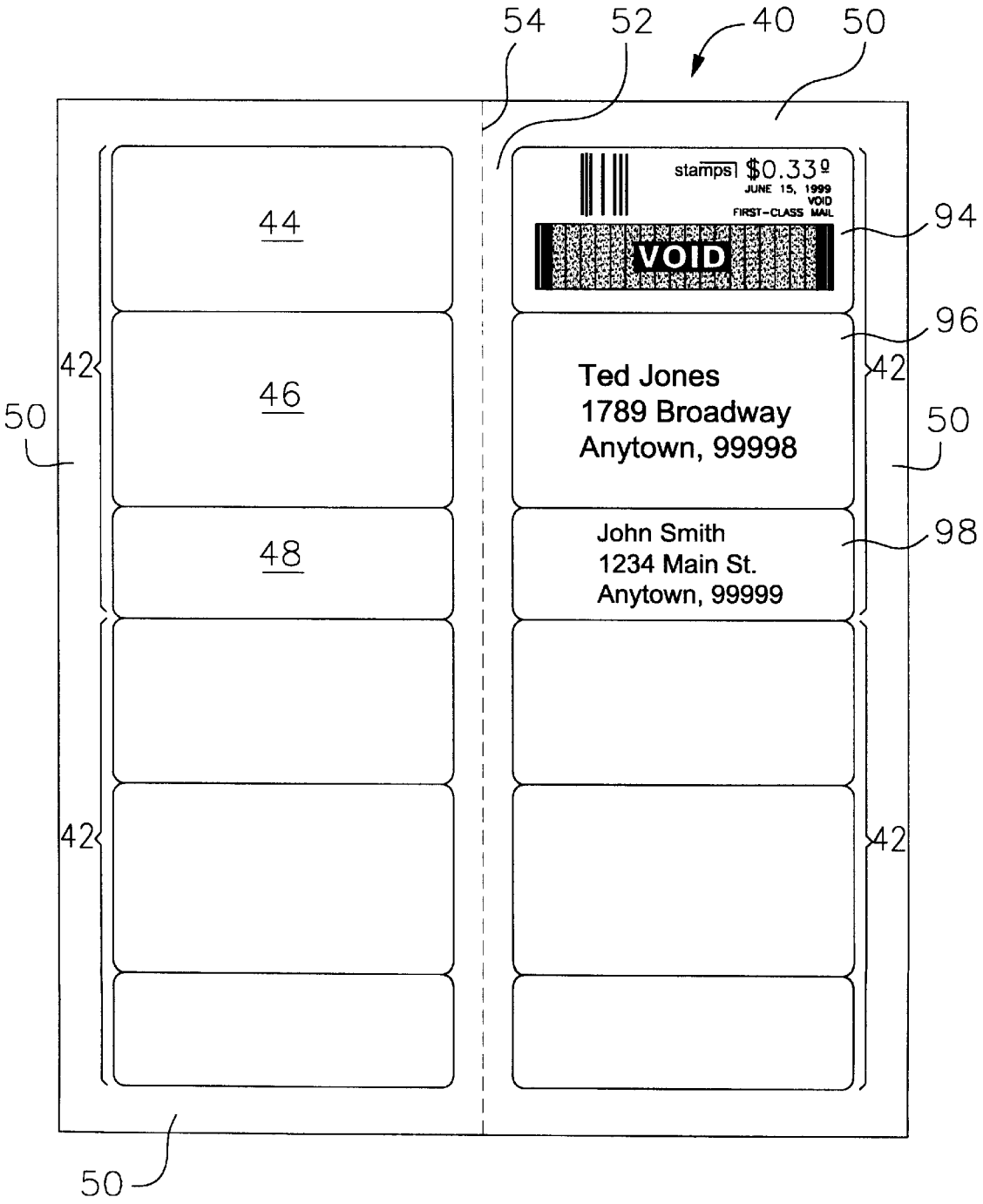
FIG. 5 is a top plan view showing a sheet of self-adhesive labels of the invention after one set of the three labels in the set is printed with the postage indicia, addressee, and sender information.

FIG. 5. is a top plan view showing a sheet of self-adhesive labels 40 of the invention after one set 42 of the three labels 44, 46 and 48 is printed with the postage indicia 94, addressee information 96, and sender information 98. Since set 42 is printed in a single pass through printer 82, the method provides an ideal method to print all labels necessary to send a mail piece with the postage indicia.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation.

What is claimed is:

1. A process for printing, in a single step, postage indicia, addressee information, and sender information onto a single sheet containing a plurality of special purpose label arrangement sets, the single sheet being sheets that are printable on single sheet feeding printers as opposed to roll-type label printers, the process comprising:

providing a computer system and a printer, the printer being a single sheet feeding printer, the computer system;

providing a single sheet of a plurality of computer printer printable self-adhesive special purpose label arrangement sets, the single sheet being sheets that are printable on single sheet feeding printers as opposed to roll-type label printers, each special purpose label arrangement set having a postage indicia label with a width and a height, an addressee label with a width and a height, and a sender label with a width and a height, the heights of the postage indicia label, the addressee label, and the sender label not all being the same, wherein the special purpose label arrangement sets are located on a printable footprint area of the single sheet and the printable footprint area is surrounded by print-free margin areas on the sheet;

providing a postage computer program adapted for use by the computer system and printer for preparing an printing postage indicia, addressee information, and sender information onto the postage indicia label, the addressee label, and sender label, respectively, of one of the plurality of the special purpose label arrangement sets;

inputting into the postage computer program information concerning the addressee, the sender, and a mail piece to be mailed; and directing the postage computer program to print the postage indicia, addressee information, and sender information onto the postage indicia label, the addressee label, and the sender label, respectively, of one of the special purpose label arrangements sets.

2. The process of claim 1, further comprising the step of obtaining postage value from a postage server wherein the postage server is separate from the computer system.

3. The process of claim 1, wherein the postage indicia, addressee information, and sender information are printed onto the postage indicia label, the addressee label, and the sender label, respectively, of one of the special purpose label arrangement sets in a single pass through the printer.

4. The process of claim 1, wherein the postage indicia label, the addressee label, and sender label in the plurality of self-adhesive special purpose label arrangement sets are sized so that the plurality of self-adhesive special purpose label arrangement sets maximally fit within the printable footprint area of the single sheet.

5. The process of claim 1, wherein the single sheet has a shorter dimension and a longer dimension and the plurality of special purpose label arrangement sets are arranged in a portrait orientation on the single sheet with a plurality of the special purpose label arrangement sets being arranged in a side-by-side orientation on a left side and on a right side of the single sheet, with top edges of the postage indicia labels, the addressee labels, and the sender labels being parallel to the shorter dimension of the single sheet.

6. The process of claim 5, wherein the sum of the heights of the postage indicia labels, addressee labels and sender labels in the plurality of special purpose label arrangement sets on the left side and right side of the single sheet is equal to the longer dimension of the printable footprint of the single sheet.

7. The process of claim 5, wherein the single sheet further comprises a weakening line that vertically bisects the single sheet along its longer dimension in a portrait mode, the weakening line allowing the single sheet to be separated into left and right sheet halves.

8. The process of claim 7, wherein the weakening line traverses a print-free central dividing area of the sheet that separates adjacent special purpose label arrangement sets on the left and right sheet halves.

9. The process of claim 8, wherein the sum of the widths of side-by-side portage indicia labels plus the width of the print-free central dividing area is equal to the shorter dimension of the printable footprint area.

10. The process of claim 5, wherein in each special purpose label arrangement set, the addressee label is positioned between the postage indicia label and the sender label.

11. The process of claim 5, wherein the postage indicia label, the addressee label, and the sender label have the same width.

12. The process of claim 5, wherein the postage indicia label and the addressee label have the same width.

13. The process of claim 1, wherein the single sheet has a shorter dimension and a longer dimension, and the plurality of special purpose label arrangement sets are arranged in a landscape orientation, with at least two special purpose label arrangement sets arranged side-by-side on the single sheet with the widths of the postage indicia label, the addressee label, and the sender label being parallel to the longer dimension of the sheet.

14. The process of claim 13, wherein the sum of the widths of the addressee labels of special purpose label arrangement sets is equal to the longer dimension of the printable footprint area of the single sheet.

15. The process of claim 13, wherein the sum of the heights of the indicia labels, sender labels and addressee labels in any one special purpose label arrangement set, plus any optional central dividing area, is equal to the shorter dimension of the printable footprint.

16. The process of claim 13, wherein right side edges of the postage indicia label portion, the addressee label portion, and the sender label portion in each set of special purpose label arrangement sets are aligned.

17. The process of claim 2, wherein the computer system is connected to the postage server through a worldwide computer network.

18. The process of claim 1, wherein the step of inputting into the postage computer program information concerning the addressee, the sender, and the mail piece to be mailed is accomplished by at least partially accessing and coordinating data from at least one other computer software program, selected from word processing software, contact management software, database software, and accounting software, and processing this data along with data in the postage computer program.

19. A process for printing, in a single step, postage indicia, addressee information, and sender information onto a single sheet containing at least one special purpose label arrangement set with a postage indicia label, an addressee label and a sender label, the single sheet being sheets being printable on single sheet feeding printers as opposed to roll-type label printers, the process comprising:

providing a computer system and a printer, the printer being a single sheet feeding printer;

providing a single sheet having at least one special purpose label set comprising a postage indicia label with a height and width, and addressee label with a height and width, and a sender label with a height and width, the single sheet being sheets that are printable on single sheet, feeding printers as opposed to roll-type label printers, the special purpose label set being on a printable footprint area of the single sheet and surrounded on the single sheet by print-free margin areas;

providing a postage computer program adapted for use by the computer system and printer for preparing and printing postage indicia, addressee information, and sender information onto the postage indicia label, the addressee label, and the sender label, respectively, of the special purpose label arrangement set; and inputting into the postage computer program information concerning the addressee, the sender, and a mail piece to be mailed; and directing the postage computer program to print the postage indicia addressee information, and sender information onto the postage indicia label, the addressee label, and the sender label of the special purpose label arrangement set in a single pass through the printer.

20. The process of claim 19, further comprising the step of obtaining postage value from a postage server.

21. The process of claim 19, wherein the postage indicia, addressee information, and sender information are printed onto the postage indicia label, the addressee label, and the sender label, respectively, of one of the special purpose label arrangement sets in a single pass through the printer.

22. The process of claim 19, wherein the heights of the postage indicia label, the addressee label, and the sender label s are not all the same.

23. The process of claim 19, wherein the at least one of self-adhesive special purpose label arrangement sets is sized to maximally fit within the printable footprint area of the single sheet.

24. The process of claim 19, wherein the single sheet has a shorter dimension and a longer dimension and a plurality of special purpose label arrangement sets are arranged in a portrait orientation on the single sheet with a plurality of the special purpose label arrangement sets being arranged in a side-by-side orientation on a left side and on a right side of the single sheet, with top edges of the postage indicia label, the addressee label, and the sender label being parallel to the shorter dimension of the single sheet.

25. The process of claim 24, wherein the sum of the heights of the postage indicia labels, addressee labels and sender labels in the plurality of special purpose label arrangement sets on the left side and right side of the single sheet is equal to the longer dimension of the printable footprint of the single sheet, and the sum of the widths of side-by-side portage indicia labels, plus the width of an optional print-free central dividing area that separates adjacent special purpose label arrangement sets on the left and right sheet halves, is equal to the shorter dimension of the printable footprint.

26. The process of claim 19, wherein the single sheet has a shorter dimension and a longer dimension, and the plurality of special purpose label arrangement sets are arranged in a landscape orientation, with at least two special purpose label arrangement sets arranged side-by-side on the single sheet with the widths of the postage indicia label, the addressee label, and the sender label being parallel to the longer dimension of the sheet.

27. The process of claim 26, wherein the sum of the widths of the addressee labels of the special purpose label arrangement sets is equal to the longer dimension of the printable footprint of the single sheet.

28. The process of claim 20, wherein the computer system is connected to the postage server through a worldwide computer network.

29. The process of claim 19, wherein the step of inputting into the computer software information concerning the addressee, the sender, and the mail piece to be mailed is accomplished by at least partially accessing and coordinating data from at least one other computer software program, selected from word processing software, contact management software, database software, and accounting software, and processing this data along with data in the postage computer program.

30. The process of claim 19, wherein in each special purpose label arrangement set, the addressee label is positioned between the postage indicia label portion and the sender label.

31. A single sheet of a plurality of computer printer printable self-adhesive special purpose label arrangement sets for use with a computer system and printer for printing the special purpose label arrangement sets with postage indicia, addressee information, and sender information, the single sheet comprising:

a plurality of special purpose label arrangement sets, each set having a postage indicia label with a width and a height, an addressee label with a width and a height, and a sender label with a width and a height, the plurality of special purpose label arrangement sets being located on and sized to maximally occupy a printable footprint area of the single sheet, the single sheet being sheets being printable on single sheet feeding printers as opposed to roll-type label printers, the printable footprint area being surrounded on all sides by print-free areas;

wherein a postage indicia label, and addressee label, and a sender label of a special purpose label arrangement set of the plurality of special purpose label arrangement sets are adapted to be printed with postage indicia, addressee information, and sender information, respectively, in a single pass through a computer printer.

32. The single sheet of claim 31, the heights of postage indicia label, the addressee label, and the sender label are different.

33. The single sheet of claim 32, wherein the postage indicia label and the addressee label have the same width.

34. The single sheet of claim 33, wherein the plurality of special purpose label arrangement sets are arranged in a portrait orientation on the single sheet having a longer dimension and a shorter dimension, a plurality of the special purpose label arrangement sets being arranged in a side-by-side orientation on a left side and on a right side of the single sheet, with a top edge of the postage indicia label, a top edge of the addressee label, and a top edge of the sender label being parallel to the shorter dimension of the single sheet, the postage indicia label, the addressee label, and the sender label of each set being positioned one against the other, and the plurality of the special purpose label arrangement sets on the left side and on a right side of the single sheet being placed one against the other, wherein the sum of the heights of the postage indicia labels, the addressee labels, and the sender labels in the plurality of the special purpose label arrangement sets on the left side and right side is equal to the longer dimension of the printable footprint of the single sheet.

35. The single sheet of claim 34, wherein the addressee label is positioned between the postage indicia label and the sender label.

36. The single sheet of claim 34, wherein the single sheet further comprises a weakening line that vertically bisects the single sheet along its longer dimension in a portrait mode, the weakening line being located on a print-free central dividing area of the sheet that separates adjacent special purpose label arrangement sets on the left side and right sides of the single sheet, thereby allowing the single sheet to be separated into left and right sides of the sheet, wherein the sum of the widths of postage indicia labels of two adjacent postage indicia labels on the single sheet, plus a width of the print-free central dividing area, is equal to a shorter dimension of the printable footprint of the single sheet.

37. The single sheet of claim 31, wherein a plurality of special purpose label arrangement sets are arranged on the single sheet in a landscape orientation, with at least two sets arranged side-by-side on the single sheet with side edges of the postage indicia label, the addressee label, and the sender label being parallel to the longer dimension of the single sheet, wherein the sum of the widths of the two adjacent sender labels is equal to a longer dimension of the printable footprint of the single sheet.

38. The single sheet of claim 37, wherein right side edges of the postage indicia label portion, the addressee label portion, and the sender label portion in each set are aligned.

39. The single sheet of claim 33, wherein the postage indicia label has a strip of fluorescent material on a right hand side edge thereof.

40. The single sheet of claim 33, wherein the single sheet is between 21.0 cm and 21.6 cm wide and between 27.9 cm and 29.7 cm long, and the print-free areas comprise an at least a 1.27 cm perimeter area around edges of the single sheet, the printable footprint area lying within the print-free areas.

* * * * *

UNITED STATES PATENT AND TRADEMARK OFFICE

CERTIFICATE OF CORRECTION

PATENT NO. : 6,244,763 B1
DATED : June 12, 2001
INVENTOR(S) : Christopher Patrick Miller It is certified that error appears in the above-identified patent and that said Letters Patent is hereby corrected as shown below:

Column 7,
Lines 29-30, after “printer” delete “, the computer system”.
Line 46, replace “preparing an” with -- preparing and --.

Column 8,
Line 32, replace “portage” with -- postage --.

Column 9,
Lines 51-52, replace “sender label s” with -- sender label --.

Column 10,
Line 5, replace “portage” with -- postage --.

Signed and Sealed this

Third Day of December, 2002

JAMES E. ROGAN
*Director of the United States Patent and Trademark Office*